US012358700B2

(12) United States Patent
Bouteloup et al.

(10) Patent No.: US 12,358,700 B2
(45) Date of Patent: Jul. 15, 2025

(54) CAPSULE ADAPTED TO SEAL THE OPENING IN A CONTAINER, AND ASSEMBLY COMPRISING A CONTAINER AND SAID CAPSULE

(71) Applicant: CORADIN SAS, Mouans-Sartoux (FR)

(72) Inventors: David Bouteloup, Peymeinade (FR); Fabrice Bourdier, Montauroux (FR); Florence Bidamant, Mulhouse (FR)

(73) Assignee: CORADIN SAS, Mouans-Sartoux (FR)

( * ) Notice: Subject to any disclaimer, the term of this patent is extended or adjusted under 35 U.S.C. 154(b) by 243 days.

(21) Appl. No.: 17/474,180

(22) Filed: Sep. 14, 2021

(65) Prior Publication Data

US 2022/0063881 A1 Mar. 3, 2022

Related U.S. Application Data

(63) Continuation of application No. PCT/FR2020/050575, filed on Mar. 17, 2020.

(30) Foreign Application Priority Data

Mar. 22, 2019 (FR) ..... 1902991

(51) Int. Cl.
*B65D 51/28* (2006.01)
*B65D 47/12* (2006.01)
*B65D 81/32* (2006.01)

(52) U.S. Cl.
CPC ..... *B65D 51/2821* (2013.01); *B65D 47/122* (2013.01); *B65D 81/3222* (2013.01)

(58) Field of Classification Search
CPC ..... B65D 51/2821; B65D 47/122; B65D 81/3222
See application file for complete search history.

(56) References Cited

U.S. PATENT DOCUMENTS 3,156,369 A 11/1964 Bowes
4,201,316 A 5/1980 Klingaman
(Continued)

FOREIGN PATENT DOCUMENTS

CN 101941552 A * 1/2011 ..... B65D 51/2835
DE 10 2005 008238 A1 8/2006
(Continued)

OTHER PUBLICATIONS

Restriction Requirement for U.S. Appl. No. 17/474,150 (Sep. 15, 2023).
(Continued)

*Primary Examiner* — Tri M Mai
(74) *Attorney, Agent, or Firm* — Jenkins, Taylor & Hunt, P.A.

(57) ABSTRACT

A capsule to seal the opening in a container, such as the neck of a bottle, wherein the container is adapted to contain a first fluid, the capsule being adapted to contain a second fluid that is different from the first fluid, the capsule being movable from a first initial position of the capsule to a second opening position of the capsule making it possible, in the second opening position, to release the second fluid into the container, thus mixing the first fluid and the second fluid, wherein the capsule is adapted to form, in its second opening position, and fixed in the opening in the container, a dispenser for the container which is adapted to dispense the contents of the container to the outside.

10 Claims, 5 Drawing Sheets

(56) References Cited

U.S. PATENT DOCUMENTS

| | | | | |
|---|---|---|---|---|
| 4,682,689 | A * | 7/1987 | Pereira | B65D 81/3211 206/217 |
| 4,982,875 | A * | 1/1991 | Pozzi | B65D 81/3222 604/416 |
| 5,421,483 | A | 6/1995 | Parise | |
| 6,041,969 | A | 3/2000 | Parise | |
| 6,116,445 | A | 9/2000 | Ikemori et al. | |
| 6,148,996 | A | 11/2000 | Morini | |
| 6,997,351 | B2 | 2/2006 | Cho | |
| 7,219,796 | B2 | 5/2007 | Anderson | |
| 8,387,786 | B2 | 3/2013 | Fontana | |
| 8,413,802 | B2 | 4/2013 | Lee et al. | |
| 8,701,906 | B1 * | 4/2014 | Anderson | B65D 41/20 215/DIG. 8 |
| 8,714,808 | B2 | 5/2014 | Yamanaka | |
| 10,940,983 | B2 | 3/2021 | Paganuzzi | |
| 2007/0170142 | A1 * | 7/2007 | Cho | B65D 51/2835 215/257 |
| 2008/0093326 | A1 | 4/2008 | Cho | |
| 2009/0184083 | A1 * | 7/2009 | Cho | B65D 47/06 215/388 |
| 2022/0063880 | A1 | 3/2022 | Bouteloup et al. | |

FOREIGN PATENT DOCUMENTS

| | | | | |
|---|---|---|---|---|
| EP | 2 700589 | A2 | 2/2014 | |
| WO | WO 98/38104 | A1 | 9/1998 | |
| WO | WO 2006/111803 | A2 | 10/2006 | |
| WO | WO 2007/006414 | A1 | 1/2007 | |
| WO | WO 2008/036889 | A2 | 3/2008 | |
| WO | WO 2008/051032 | A1 | 5/2008 | |
| WO | WO-2009031864 | A2 * | 3/2009 | B65D 51/2828 |
| WO | WO 2009/073998 | A1 | 6/2009 | |
| WO | WO 2010/143617 | A1 | 12/2010 | |
| WO | WO 2020/193917 | A1 | 10/2020 | |
| WO | WO 2020/193918 | A1 | 10/2020 | |

OTHER PUBLICATIONS

First Examination for European Patent Application 20 726 225.4 (Mar. 20, 2023).
Final Office Action for U.S. Appl. No. 17/474,150 (Jul. 26, 2024).
Advisory Action for U.S. Appl. No. 17/474,150 (Nov. 5, 2024).
Non-Final Office Action for U.S. Appl. No. 17/474,150 (Dec. 6, 2024).
Non-Final Office Action for U.S. Appl. No. 17/474,150 (Feb. 28, 2024).
International Search Report and Written Opinion for Application No. PCT/FR2020/050575 dated Jun. 18, 2020.
International Search Report and Written Opinion for Application No. PCT/FR2020/050576 dated Jun. 18, 2020.
Notice of Allowance for U.S. Appl. No. 17/474,150 (May 27, 2025).
Office Action for European Patent Application Serial No. 20 726 225.4 (Apr. 10, 2025).

* cited by examiner

CAPSULE ADAPTED TO SEAL THE OPENING IN A CONTAINER, AND ASSEMBLY COMPRISING A CONTAINER AND SAID CAPSULE

CROSS-REFERENCE TO RELATED APPLICATIONS

This application is a continuation of and claims priority to PCT/EPFR2020/050575 filed Mar. 17, 2020 which claims priority to French Patent Application No. 1902991 filed Mar. 22, 2019, the entire disclosures of which are herein incorporated by reference.

TECHNICAL FIELD

The invention relates to a capsule adapted to seal the opening in a container, such as the neck of a bottle, wherein said container is adapted to contain a first fluid, the capsule, in turn, being adapted to contain a second fluid that is different from said first fluid.

The capsule according to the present invention is adapted to release said second fluid into the container at a moment determined by the user. The invention also relates to an assembly composed of a container adapted to package a first fluid, and a capsule according to the invention.

BACKGROUND

Capsules adapted to provide a space intended to contain a second fluid have already been disclosed in the prior art. At a moment determined by the user, the contents of the capsule, namely the second fluid, may be released in order to allow a mixing between the first fluid, present in the interior of the container, and the second fluid.

A first use known from the prior art consists in using a container containing a fluid, of the cosmetic type, in combination with a capsule in which an active ingredient is packaged. For efficacy reasons, it may prove advantageous to mix the active ingredient and the cosmetic fluid just prior to using them. In other words, the user may choose the moment at which he/she mixes the active ingredient with the cosmetic fluid and apply, directly after the mixing, said fluid onto his/her skin.

Active ingredients, which are particularly adapted to be packaged in packages of this type, may be presented in a pure state that is either acidic or corrosive. It is imperative to avoid all direct contact between the user's skin and an active ingredient of this type.

The use of a container containing a first fluid and of a capsule containing an active ingredient has another drawback if one of the two fluids is contaminated before the mixture has been produced.

For the reasons set out above, there is a need to propose new solutions that make it possible to ensure optimal and safe mixing of a first fluid, contained in the interior of a container, and a second fluid which is contained in the interior of a capsule and which is adapted to be mixed with said first fluid contained in the interior of said container.

SUMMARY

The subject of the present invention relates to a capsule adapted to seal the opening in a container, such as the neck of a bottle, wherein said container is adapted to contain a first fluid, the capsule being adapted to contain a second fluid that is different from said first fluid, said capsule being movable from a first initial position of the capsule to a second opening position of the capsule, making it possible, in said second opening position, to release said second fluid into the container, thus mixing the first fluid and the second fluid, wherein said capsule is adapted to form, in its second opening position, and fixed in the opening in the container, a dispenser for said container which is adapted to dispense the contents of the container to the outside.

According to one embodiment of the invention, the capsule comprises fixing structure(s), such as a rib, making it possible to fix the capsule in the opening in the container.

According to one embodiment of the invention, the capsule comprises a first member and a second member, together delimiting a volume for containing said second fluid, wherein said first member and said second member are movable, in relation to one another, from the first initial position of the capsule, together delimiting a first volume, to the second opening position of the capsule delimiting a second volume which is less than the first volume.

According to one embodiment of the invention, the capsule comprises a striker fixed onto one of said first and second members of the capsule, said striker being adapted to strike, during the movement of the members from the first initial position of the capsule to the second opening position of the capsule, a receptacle comprising the second fluid, to thus release said second fluid into the container.

According to one embodiment of the invention, the first member of the capsule is adapted to be fixed in the opening in the container and the second member is movable in relation to said first member fixed in the opening in the container.

According to one embodiment of the invention, the first member comprises a bearing wall adapted to come into contact with the edge of the opening in the container, in order to limit the insertion of the first member into the interior of said opening by said bearing wall.

According to one embodiment of the invention, the second member comprises an opening adapted to form said dispenser for the container.

According to one embodiment of the invention, the capsule is adapted to receive, in its interior, a cartridge comprising said second fluid.

According to one embodiment of the invention, the capsule comprises a lid for covering said dispenser, said lid being provided with a thread adapted to cooperate with a thread present on the exterior of a container and said lid being adapted to be fixed onto the container by said thread.

According to one embodiment of the invention, the lid is adapted to fix the capsule in the opening in the container during the fixing of the lid onto the container by said thread.

According to a second aspect of the invention, the invention relates to an assembly comprising a container, adapted to contain a first fluid, with an opening that makes it possible to fill and empty said container, a capsule according to the invention, said capsule being adapted to contain a second fluid that is different from said first fluid, and to seal said opening in the container, wherein said capsule is movable from a first initial position of the capsule to a second opening position of the capsule making it possible, in said second opening position, to release said second fluid into the container, thus mixing the first fluid and the second fluid, wherein said capsule is adapted, in its second opening position and fixed in the opening in the container, to form a dispenser for said container, and adapted to dispense the contents of the container to the outside, and a lid adapted to seal said dispenser.

According to one embodiment of the invention, the invention relates to an assembly wherein the lid is provided with a thread adapted to cooperate with a thread present on the exterior of a container, said lid being adapted to be fixed onto the container by said thread and also being adapted to fix the capsule in the opening in the container during the fixing of the lid onto the container by said thread.

BRIEF DESCRIPTION OF THE DRAWINGS

The aim, subject and characteristics of the invention will become more clearly apparent on reading the following description with reference to the figures, in which.

DETAILED DESCRIPTION

Figure 1:
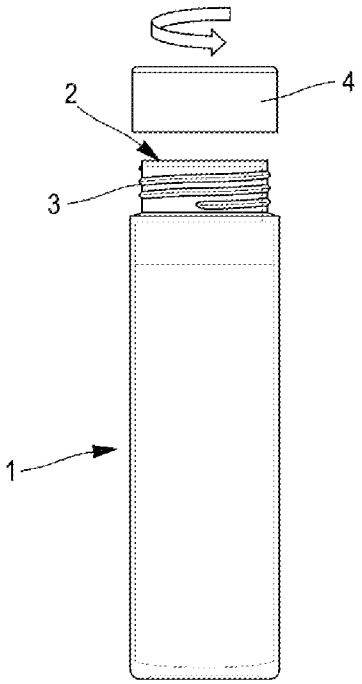
FIG. 1 shows a container adapted to contain a first fluid and a protection member for sealing the opening in said container.

FIG. 1 shows a container 1 adapted to contain a first fluid. The container 1, in principle adapted to contain any type of fluid, is particularly adapted to contain a cosmetic fluid, for example a fluid adapted to be applied onto the skin of a user.

The container 1 comprises an opening 2 adapted for filling said container 1 with the first fluid. The container 1 is provided, in the vicinity of the opening 2, with fixing structure(s), such as a thread 3, allowing a protection member 4 to be fixed onto said container 1.

Figure 2:
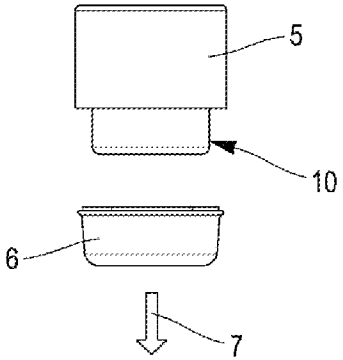
FIG. 2 depicts a capsule adapted to seal the opening in the container according to FIG. 1, in combination with a security member for said capsule, FIG. 3 diagrammatically illustrates the fixing of the capsule according to FIG. 2 onto the container according to FIG. 1.

FIG. 2 shows the exterior of the assembly composed of a capsule 10 according to the invention on which a lid 5 is fitted in combination with a security member 6. Said security member may be positioned on the capsule 10 in order to protect it during storage and transportation of said capsule 10. As indicated by the arrow 7, the security member 6, which is detachable, may be removed prior to use of the capsule 10.

Figure 3:
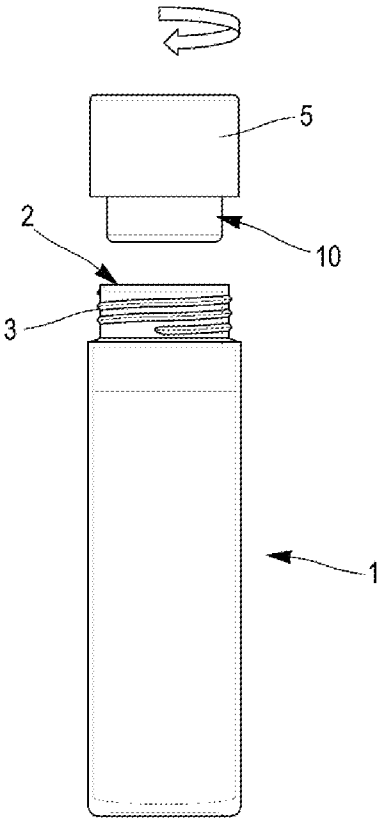

FIG. 3 illustrates, diagrammatically, the fixing of the capsule 10 onto the container 1 by the lid 5. Said capsule 10 is dimensioned in such a way as to allow it to be introduced into the interior of the opening 2 in the container 1 and to be fixed in the interior of said opening 2. As explained in more detail hereinbelow, the capsule 10 is first of all positioned in the opening 2. A thread 51 present in the interior of the lid 5 makes it possible, in combination with said thread 3 present on the exterior of the container 1, to fix the lid 5 onto said container 1 and, simultaneously, to insert the capsule 10 into the interior of the container 1. The security member 6, as shown in FIG. 2, is removed from the capsule 10, this being done prior to the fixing of the capsule 10 in the interior of the opening 2 in the container 1. Said security member is used during storage and transportation of the capsule 10 in order to protect it from possible contamination by unwanted external elements.

Moreover, it should be noted that the protection member 4, as illustrated in FIG. 1 must be removed from said container 1 before the capsule 10 is fixed in the interior of the opening 2 in the container 1. The protection member 4 is used to protect the contents of the container 1 from possible contamination by unwanted external elements before the capsule 10 is fixed in the opening 2 in the container 1.

Figure 4:
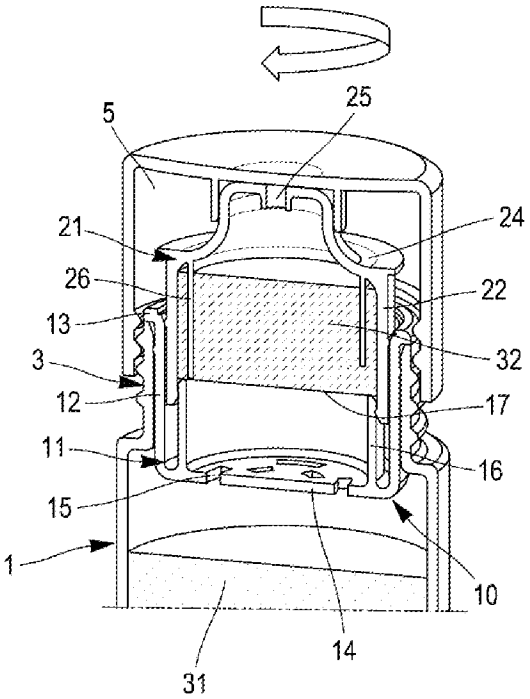
FIG. 4 shows a sectional view of a capsule, according to a first embodiment of the invention, positioned in the opening in the container, said capsule being shown in its first initial position.

FIG. 4 depicts a detailed view, in section, of the fixing of the capsule 10 onto the container 1. FIG. 4 illustrates the container 1, the interior of which is provided with a first fluid 31. The capsule 10 adapted to seal the opening 2 in the container 1 is introduced into said opening 2. According to the embodiment depicted in FIG. 4, the capsule 10 comprises a first member 11, the dimensions of which guarantee an optimal leakproof connection between the inner wall of the container 1 and the outer wall 12 of said first member 11 of said capsule 10 as soon as this first member 11 is inserted into the interior of the opening 2.

The first member 11 of the capsule 10 substantially has the form of a cylinder comprising an outer wall 12 provided with a bearing wall 13 at its upper end. The bearing wall 13 of said outer wall 12, having the function of coming into contact with the rim of the opening 2 in the container 1, determines the maximum insertion of the capsule 10 into the interior of said container 1. The first member 11 is provided with a lower wall 14 comprising at least one orifice 15 that allows the second fluid contained in the capsule 10 to flow, after it has been opened. A cylindrical member 16, positioned on the wall 14, is provided with a protective cover 17 at its upper end, which protective cover 17 makes it possible to prevent the second fluid 32, which is contained in the capsule 10, from being able to flow from said capsule 10 before it is opened.

Figure 5:
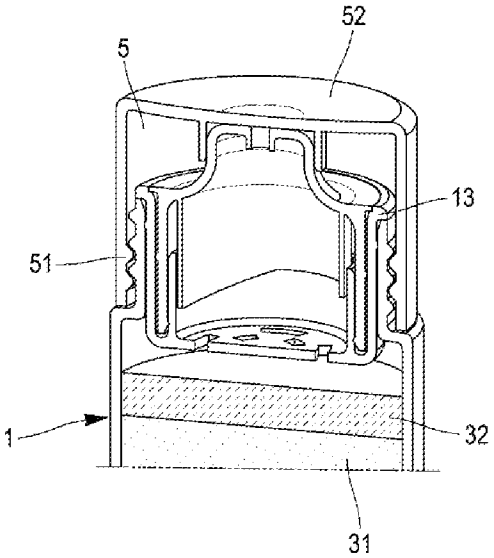
FIG. 5 depicts the capsule according to FIG. 4 in its second opening position.

The capsule 10 is provided with a second member 21, which has a substantially cylindrical form, having an outer wall 22. Said second member 21 comprises, at its upper end, an upper wall 24 in the form of a dispenser, said wall 24 being provided with an upper opening 25. The upper wall 24 of the second member 21 forms, in combination with said opening 25, a dispenser for the container 1 as soon as the capsule 10 has been displaced from its initial position as illustrated in FIG. 4 to its opening position as illustrated in FIG. 5.

A striker 26, which has a substantially cylindrical form, is present on the upper wall 24, in the interior of the second member 21. A detailed depiction of the form of the striker 26 is illustrated in FIG. 5. As depicted in FIG. 4, and before the capsule 10 has been opened, the dispenser formed by the upper wall 24 of the second member 21 and the opening 25 is sealed by a lid 5.

FIG. 4 illustrates the capsule 10 in its first initial position in which the fluid 32, which is contained in the interior of said capsule 10, cannot mix with the first fluid 31 present in the interior of the container 1. This is guaranteed by the presence of the protective cover 17, which ensures that there is a leakproofness preventing the fluid 32 from flowing from the capsule 10.

The first member 11 and the second member 21, as depicted in FIG. 4 together delimit a volume that makes it possible to receive the second fluid 32. In the initial position of the capsule 10, as shown in FIG. 4, the first member 11 and the second member 21 together delimit a first volume and may be displaced in relation to one another to a second opening position of said capsule 10 as shown in FIG. 5.

As illustrated in FIG. 5, the volume delimited by the assembly composed of the first member 11 and the second member 21, in the opening position of the capsule 10, is limited in comparison with the volume delimited in the initial position of said capsule 10. In the opening position of the capsule 10, as depicted in FIG. 5, the protective cover 17 has been opened with the lower edge of the striker 26, thus allowing the second fluid 32 to flow out of the capsule 10 and mix with the first fluid 31 present in the interior of the container 1. For the sake of clarity, the example illustrated in FIG. 5 shows the presence of the second fluid 32 above the surface of the first fluid 31. In order to ensure optimal mixing of the first fluid 31 and the second fluid 32, the user may shake the assembly of the container 1 and the lid 5 prior to use of said mixture.

According to the example illustrated in FIGS. 4 and 5, the first member 11 is inserted to its maximum extent into the interior of the opening 2 of the container 1. The maximum distance travelled during the insertion of the first member 11 into the interior of the container 1 is determined by the presence of the bearing wall 13 that has come into contact with the upper rim of said container 1. As soon as the first member 11 is fixed onto said upper rim of the container 1, the second member 21 is displaced in the direction of the first member 11 by the lid 5. As illustrated in FIGS. 4 and 5, the interior of said lid 5 is provided with a thread 51 adapted to cooperate with the thread 3 present on the exterior of the container 1. By moving the lid 5 forward, the upper wall 52 of this lid 5 exerts pressure onto the second member 21, thus displacing this second member 21 in the direction of the interior of the container 1. The protective cover 17, as illustrated in FIG. 4, is opened by virtue of the presence of the striker 26. This means that the separation, which prevents the second fluid 32 from flowing out of the capsule 10, is removed so that said fluid 32 may then flow from said capsule 10 into the interior of the container 1.

As illustrated in FIG. 5, the assembly composed of the first member 11 and the second member 21 of the capsule 10, forms a dispenser for the container 1 that is adapted to dispense the contents of said container 1 to the outside. As a result, once the capsule 10 is open, if the user removes the lid 5, the assembly of the first member 11 and the second member 21 of the capsule 10 remains fixed in the opening 2 in the container 1. According to one embodiment, the outer wall of the container 1 retains some flexibility, which allows the user to exert some pressure with his/her fingers onto the contents of the container 1, thus releasing a determined amount of fluid to the outside.

Figure 6:
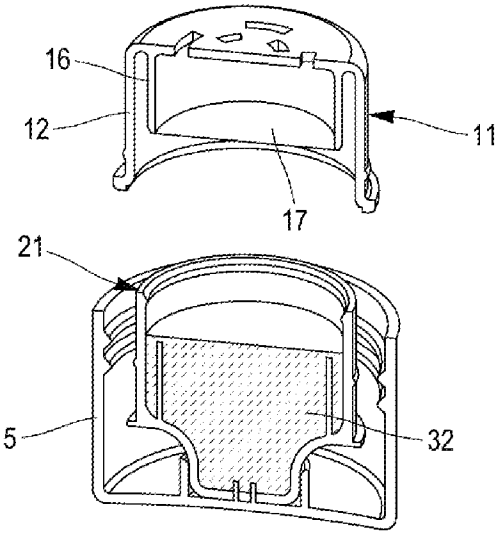
FIG. 6 illustrates a diagrammatic depiction of the filling of the capsule according to FIGS. 4 and 5.
Figure 7:
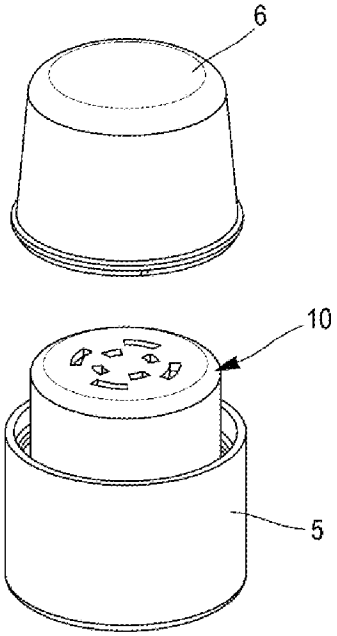
FIG. 7 shows the capsule according to FIGS. 4, 5 and 6 and a security member for said capsule.

FIG. 6 shows, diagrammatically, the filling of the capsule 10 according to FIGS. 4 and 5. First of all, the second member 21 of the capsule 10 is positioned in the interior of the lid 5. In this position, the opening 25 in the upper wall 24 of the second member 21, said second member 21 is ready to be filled with the second fluid 32. When the second fluid 32 is received in the interior of the second member 21 of the capsule 10, the first member 11 is positioned on the second member 21. During this assembling, the outer wall 22 of the second member 21 is received between, respectively, the outer wall 12 of the first member 11 and the cylindrical member 16 of said first member 11. The first member 11 and the second member 21 are inserted one inside the other until a leakproof connection between said two members 11, 12 is obtained while ensuring that the protective cover 17 cannot be pierced by the striker 26. As soon as the assembling, illustrated in FIG. 6, is performed, the assembly composed of the capsule 10 and the lid 5 may be completed by a security member 6 for the transportation and storage of said capsule 10, as illustrated in FIG. 7.

Figure 8:
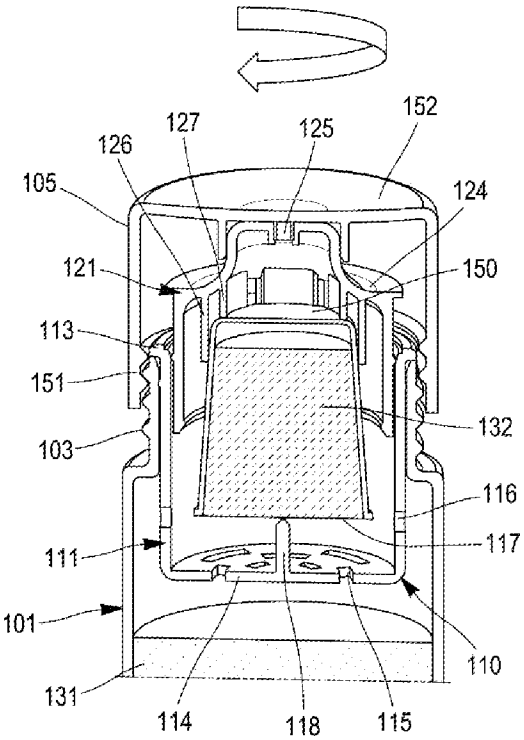
FIG. 8 depicts a sectional view of a capsule according to a second embodiment, positioned in the opening in a container and shown in its first initial position.

FIG. 8 depicts a capsule 110 according to a second embodiment of the invention. The capsule 110 comprises a first member 111 and a second member 121, which are movable in relation to one another. In the interior, the first member 111 and the second member 121 delimit a space that is intended to receive a second fluid 132. According to the embodiment illustrated in FIG. 8, the second fluid 132 is packaged in a cartridge 150. Said cartridge 150 is sealed by a protective cover 117. As described in more detail hereinbelow, said protective cover 117 is adapted to be pierced by a striker 118 fixed on the lower wall 114 of the first member 111.

FIG. 8 illustrates the capsule 110 in a first initial position in which the second fluid 132, which is contained in the cartridge 150, cannot mix with the first fluid 131 present in the container 101 on which the capsule 110 is positioned.

Figure 9:
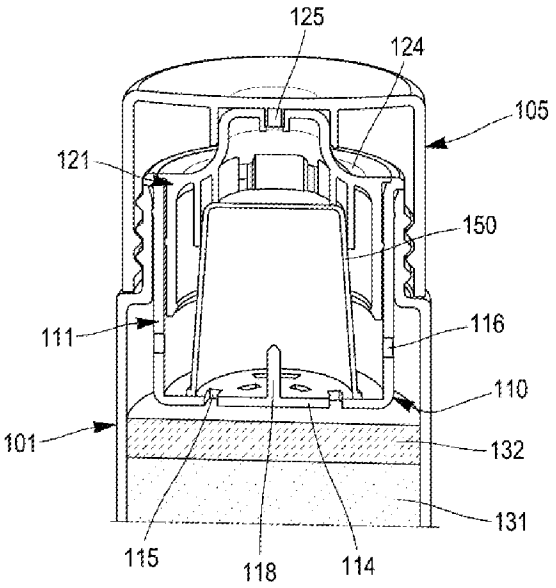
FIG. 9 illustrates the capsule according to FIG. 8, in its second opening position.

The first member 111 is provided with a bearing wall 113 adapted to come into contact with the upper edge of the container 101. Prior to use, the first member 111 of the capsule 110 is introduced into the interior of the container until said bearing wall 113 is in contact with said upper edge of the container 101. The capsule 110 may be displaced, from its initial position as shown in FIG. 8, in the direction of a second opening position as illustrated in FIG. 9. According to the example illustrated in FIG. 8, the second member 121 is movable in the direction of the first member 111 by the lid 105. The upper wall 152 is adapted to exert force onto the upper end of the second member 121 so as to insert said second member 121 into the interior of the first member 111 of the capsule 110. As illustrated in FIG. 8, the interior of the lid 5 is provided with a thread 151, which thread 151 may cooperate with the thread 103 present on the exterior, in the vicinity of the opening in the container 101.

The interior of the second member 121 is provided with guiding push-pieces 126, 127, which guiding push-pieces 126, 127 are used to move the cartridge 150 forward in the direction of the striker 118 as soon as said second member 121 is displaced in the direction of the first member 111 of the capsule 110. As a result, with the cartridge 150 sufficiently moved forward, the striker 118 strikes the protective cover 117, thus releasing the second fluid 132 and allowing the mixing of said second fluid 132 and the first fluid 131 present in the interior of the container 101. The lower wall 114 of the first member 111 is provided with at least one orifice 115 which thus allows the second fluid 132 to penetrate into the interior of the container 101.

As illustrated in FIG. 8, the upper wall 124 of the second member 121 has the form of a dispenser and has an opening 125 at its end. When the capsule 110 is situated in its second opening position, as shown in FIG. 9, the pointed form of the upper wall 124 and the opening 125 together form a dispenser for the contents of the container 101.

FIG. 9 depicts the capsule 110 in its second opening position in which the second member 121 is inserted to the maximum extent into the interior of the first member 111 of said capsule 110. The volume delimited by the first member 111 and the second member 121 in the second opening position illustrated in FIG. 9 is much more limited than the volume delimited, in the initial position illustrated in FIG. 8, by the first member 111 and the second member 121. According to FIG. 8, it can clearly be seen that the striker 118 is completely inserted into the interior of the capsule 150. The protective cover 117 (not visible in FIG. 9) is completely opened by the striker 118. The second fluid 132 flows into the interior of the container 101 by virtue of the orifices 115 which are situated in the lower wall 114 of the first member 111. According to the example illustrated in FIG. 9, the second fluid 132 is depicted as an independent layer superimposed on the first fluid 131 present in the interior of the container 101. In practice, the first fluid 131 and the second fluid 132 are adapted to be mixed. Prior to expelling the mixed product, the user may shake the container 101 so as to ensure that said first fluid 131 and said second fluid 132 have been mixed optimally. In order to expel fluid out of the container 101, in the second position of the capsule 110 as illustrated in FIG. 9, the user must first of all take off the lid 105. As soon as this lid 105 is removed, the capsule 110 remains fixed in the opening in the container 101. When the lid 105 is removed, the opening 125 situated in the pointed part of the wall 124 of the second member 121 is free and may be used to dispense the contents of the container 101.

According to the embodiment of this example, the outer wall of the container 101 may be flexible to allow the user to exert pressure with his/her fingers onto the exterior of said container 101 and thus release a determined amount of fluid out of the container 101.

In order to expel an amount of fluid, this fluid flows through openings 116 situated in the outer wall of the first member 111. With the cartridge 115 firmly applied against the lower wall 114 of the first member 111, there is no risk to the user that the second fluid 132 may flow from the container 101 without first of all being mixed with the first fluid 131. This means that the capsule 110 makes it possible to prevent the second fluid 132, in its pure state, from flowing from said container 101.

Figure 10:
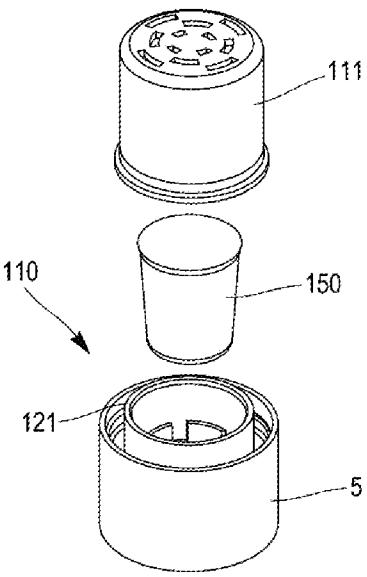
FIG. 10 shows a diagrammatic view of the assembling of the capsule according to FIGS. 8 and 9.
Figure 11:
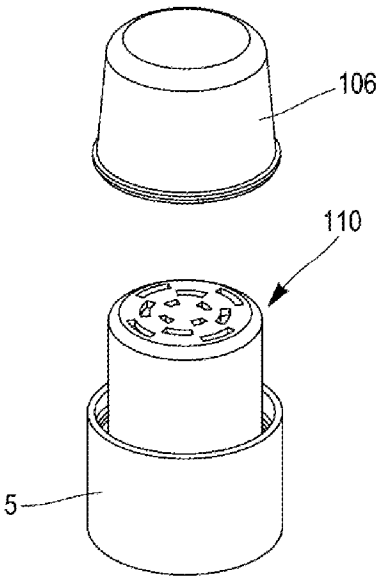
FIG. 11 depicts the capsule according to FIGS. 8, 9 and 10 and a security member for said capsule.

FIG. 10 shows a diagrammatic view of the assembling of a capsule 110 according to the invention. First of all, the second member 121 of the capsule 110 is positioned and fixed in the interior of the lid 105, then a cartridge 150 is positioned in the interior of the second member 121. The assembly is then completed with a first member 111 which, for its part, is positioned on the exterior of said second member 121. As illustrated in FIG. 11, for security reasons, a security member 106 may be positioned on the capsule 110 so as to avoid potential contamination during storage or transportation of said capsule 110.

The invention claimed is:

1. A capsule to seal an opening in a container, wherein the container is adapted to contain a first fluid, the capsule being adapted to contain a second fluid that is different from the first fluid, the capsule being movable from a first initial position of the capsule to a second opening position of the capsule making it possible, in the second opening position, to release the second fluid into the container, thus mixing the first fluid and the second fluid, wherein the capsule is adapted to form, in its second opening position, and fixed in the opening in the container, a dispenser for the container which is adapted to dispense contents of the container to outside of the container, wherein the capsule comprises a first member and a second member, together defining a volume for containing the second fluid, wherein the first member and the second member are movable, in relation to one another, from the first initial position of the capsule, together defining a first volume, to the second opening position of the capsule defining a second volume, less than the first volume, wherein the first member comprises a wall comprising at least one orifice, the first member also comprises an outer wall and a cylindrical member to receive the outer wall of the second member and the capsule comprises a striker on the upper wall of the second member.

2. The capsule according to claim 1, wherein the capsule comprises fixing structure making it possible to fix the capsule in the opening in the container.

3. The capsule according to claim 1, wherein the capsule comprises a striker fixed onto one of the first and second members of the capsule, the striker being adapted to strike, during movement of the members from the first initial position of the capsule to the second opening position of the capsule, a receptacle comprising the second fluid, to thus release the second fluid into the container.

4. The capsule according to claim 1, wherein the first member of the capsule is adapted to be fixed in the opening in the container and wherein the second member is movable in relation to the first member fixed in the opening in the container.

5. The capsule according to claim 4, wherein the first member comprises a bearing wall adapted to come into contact with an edge of the opening in the container, in order to limit insertion of the first member into an interior of the opening by the bearing wall.

6. The capsule according to claim 4, wherein the second member comprises an opening adapted to form the dispenser for the container.

7. The capsule according to claim 1, wherein the capsule comprises a lid for covering the dispenser, wherein the lid comprises a thread adapted to cooperate with a thread present on an exterior of a container, wherein the lid is adapted to be fixed onto the container by the thread.

8. The capsule according to claim 7, wherein the lid is adapted to fix the capsule in the opening in the container during fixing of the lid onto the container by the thread.

9. An assembly comprising a container, adapted to contain a first fluid, with an opening that makes it possible to fill and empty the container, a capsule according to claim 1, the capsule being adapted to contain a second fluid that is different from the first fluid, and to seal the opening in the container, wherein the capsule is movable from a first initial position of the capsule to a second opening position of the capsule making it possible, in the second opening position, to release the second fluid into the container, thus mixing the first fluid and the second fluid, wherein the capsule is adapted, in its second opening position and fixed in the opening in the container, to form a dispenser for the container, and adapted to dispense the contents of the container to outside of the container, and a lid adapted to seal the dispenser.

10. The assembly according to claim 9, wherein the lid comprises a thread adapted to cooperate with a thread present on an exterior of a container, wherein the lid is adapted to be fixed onto the container by the thread and wherein the lid is adapted to fix the capsule in the opening in the container during fixing of the lid onto the container by the thread.

* * * * *